United States Patent [19]

Baldwin et al.

[11] 4,000,078

[45] Dec. 28, 1976

[54] REACTION PRODUCT OF 1,5,9-DECATRIENE AND HYDROGEN SULFIDE AS LUBRICANT ANTI-WEAR ADDITIVES

[75] Inventors: Bernard A. Baldwin; Donald H. Kubicek, both of Bartlesville, Okla.

[73] Assignee: Phillips Petroleum Company, Bartlesville, Okla.

[22] Filed: May 9, 1975

[21] Appl. No.: 575,929

[52] U.S. Cl. ..... 252/45; 260/139; 260/609 B

[51] Int. Cl.[2] ..... C10M 1/38

[58] Field of Search ..... 252/45; 260/139, 609 B

[56] References Cited

UNITED STATES PATENTS

| | | | |
|---|---|---|---|
| 2,382,700 | 8/1945 | Eby | 252/45 |
| 2,822,332 | 2/1958 | Logan | 252/45 |
| 3,361,761 | 1/1968 | Gunning | 260/609 B X |
| 3,689,568 | 9/1972 | Eletto et al. | 260/609 B |

FOREIGN PATENTS OR APPLICATIONS

| | | | |
|---|---|---|---|
| 536,584 | 1/1957 | Canada | 252/45 |

OTHER PUBLICATIONS

Hoffert et al., "Reaction of Sulphur, Hydrogen Sulphide and Mercaptans with Unsaturated Hydrocarbons," J. Inst. of Petroleum, 1949, vol. 35, pp. 181–182.

*Primary Examiner*—Delbert E. Gantz
*Assistant Examiner*—Andrew H. Metz

[57] ABSTRACT

Improved anti-wear additives for lubricants are provided which additives comprise the reaction product obtained by the reaction of 1,5,9-decatriene and hydrogen sulfide. Lubricating oil compositions containing said additives are also provided.

7 Claims, No Drawings

REACTION PRODUCT OF 1,5,9-DECATRIENE AND HYDROGEN SULFIDE AS LUBRICANT ANTI-WEAR ADDITIVES

This invention relates to improved additives for lubricants. In one aspect, this invention relates to the preparation of novel compositions of matter formed from 1,5,9-decatriene and hydrogen sulfide. In accordance with another aspect, this invention relates to lubricant compositions containing as an additive the reaction product formed from 1,5,9-decatriene and hydrogen sulfide.

Many lubricants, such as lubricating motor oil, require efficient anti-wear additives to prevent or reduce scuffing or unreasonable wear caused by contact of moving metal parts. Indeed, such anti-wear additives are absolutely essential for the satisfactory lubrication of modern high-compression internal combustion engines.

For many years, a particularly effective anti-wear agent, zinc dialkyldithiophosphate (ZDTP), has been widely used. Despite the fact that this additive has been found very effective and very successful in a number of lubricating motor oils, it is presently considered desirable to replace this additive with another. The advent of catalytic exhaust converters on the automobile scene has precluded the use of lead compounds or other similar materials in gasolines in order to prevent premature fouling of the catalyst. Therefore, the elimination of heavy metal compounds such as zinc compounds from motor oils is also under strong consideration in order to avoid the migration of such substances through the combustion chamber and into the catalytic zone where it might poison the catalyst. Consequently, a substantial effort has been made to find a replacement for ZTDP which would not only be as effective as that agent but which would also be free of extraneous elements such as zinc or phosphorus.

The present invention now provides an anti-wear additive which, primarily, contains only the element sulfur in addition to the elements of carbon and hydrogen. Sulfur is generally considered an element which can be tolerated by catalytic exhaust systems. Moreover, the invention additive has been found to have anti-wear properties which are superior to those of ZDTP.

An object of this invention is to provide anti-wear additives for lubricants.

Another object of this invention is to provide improved lubricating compositions utilizing the additives of the invention.

Another object of this invention is to provide a method for the preparation of additives for lubricating oils.

Other objects, aspects, and the several advantages of this invention will be apparent to those skilled in the art upon a reading of the specification and appended claims.

Thus, according to the invention, there is provided new compositions of matter comprising the oil-soluble reaction product or products obtained upon reacting 1,5,9-decatriene and hydrogen sulfide.

Further, according to the invention, there is provided a process for producing additives for lubricants which comprises reacting 1,5,9-decatriene and hydrogen sulfide under conditions of UV excitation.

Further, according to the invention, there is provided as a new additive for lubricants a product additive obtained by the process described in the preceding paragraph.

Still further, according to the invention, there is provided new lubricating oil compositions comprising a major proportion of a mineral lubricating oil base stock and a minor proportion of a new additive in accordance with the invention.

The anti-wear additive of the present invention is the product obtained by the reaction of 1,5,9-decatriene and hydrogen sulfide under conditions of UV excitation. Except for the removal of unconverted decatriene and hydrogen sulfide, the entire reaction mixture, which can comprise a mixture of sulfur-containing compounds, is not further separated into components but is used in its entirety as the lubricant additive.

Thus, in another embodiment, the invention lubricant additive is the product resulting from (a) the contact, under reaction conditions, of 1,5,9-decatriene and hydrogen sulfide wherein about 2 to about 10 moles of hydrogen sulfide are present for each mole of decatriene and wherein the conditions of UV excitation, time, temperature, and pressure are sufficient to provide a reaction product mixture in which at least 75 mole percent of the decatriene has been converted, and (b) the removal of unreacted decatriene and $H_2S$ from said reaction product mixture.

A wide variety of reaction conditions can be employed in the practice of the invention. Any reaction conditions under which the reactions involved in the invention will take place are within the scope of the invention. Similarly, any proportions of reactants which will react with each other to produce a product additive of the invention are within the scope of the invention. However, as will be understood by those skilled in the art in view of this disclosure, certain reaction conditions and reactant proportions are favored for economic reasons, i.e., the reactions proceed faster and give greater yields for some reaction conditions and some proportions of reactants. The reaction or reactions involved in preparing the product additives of the invention can be carried out in the presence or absence of a diluent which is chemically inert, i.e., does not react with the reactants or reaction products.

The reaction of 1,5,9-decatriene and hydrogen sulfide can be carried out at any temperatures in which the reaction(s) involved will proceed. Generally speaking, said reaction is carried out at temperatures within the range of about 0° to about 150° C although it is within the scope of the invention to employ operable temperatures outside said range.

A wide range of reaction times can be employed in the practice of the invention. Generally speaking, the reaction times employed for the reaction of said reactants will be within the range of about 1 to about 24 hours. However, it is within the scope of the invention to employ operable times outside said range.

The reaction pressure can be any pressure suitable for carrying out the reaction involved. Generally speaking, the reaction pressure will be within the range of from about 50 to about 2,000 psig.

The ultraviolet radiation used in the reaction employs the sources, apparatus, and techniques which are well known in the art and particularly in the art of reacting hydrogen sulfide with unsaturated compounds. The ultraviolet radiation can contain some visible light but will contain a substantial amount of radiation in the range of about 100 to about 400 Angstroms. Any suitable source of such ultraviolet radiation can be employed, including such sources as mercury vapor lamps, photo lamps, sun lamps, sunlight, and the like. If desired, minor amounts of materials which are known to be initiators of ultraviolet reactions can be present. Some examples of these are trimethyl phosphite, naphthalene mercaptan, and the like.

The reaction is preferably carried out in the absence of a solvent or diluent, although any suitable diluent can be present, if desired, which does not absorb substantial amounts of the ultraviolet radiation.

The unreacted decatriene and $H_2S$ can be removed from the reaction product mixture by any suitable procedure. It is particularly convenient to subject the mixture to evaporation under conditions of heat and reduced pressure until the more volatile decatriene and $H_2S$ are stripped away from the less volatile product. After the decatriene and $H_2S$ have been substantially removed, the product is ready for formulation into the lubricating composition.

The lubricant composition into which the anti-wear additive can be formulated can be any such lubricating composition in which anti-wear or anti-scuffing protection is desirable. Thus, such compositions can include motor oils, greases, automatic transmission oils, cutting oils, hydraulic fluid, and the like. The present invention additives are found to be particularly suitable for incorporation into motor oils.

These lubricating compositions are based on lubricating mineral oils of petroleum origin which are widely used in lubricating formulations. These are preferably refined mineral oils produced by well-known refining processes employing hydrogenation, polymerization, dewaxing, solvent extraction, etc. These oils generally have a Saybolt viscosity at 100° F in the range of about 60 to about 5,000 and a Saybolt viscosity at 210° F of from about 30 to about 250. The mineral oils can be paraffinic, naphthenic, or aromatic, or mixtures of these.

When the lubricant compositions are in the form of a grease, they will contain a suitable thickener such as lithium soap or a hydrocarbon polymer. Such grease compositions are well known in the art, and they are generally prepared by dispersing soaps and/or polymers in the oil at elevated temperatures.

As with most lubricant additives, the amount of invention anti-wear additive incorporated into the lubricating composition will vary according to the total composition of the lubricant and the specific lubricating application, but will generally be in the range of from about 0.1 to about 4, preferably from about 0.3 to about 2 percent by weight of the total lubricating composition.

Although the specific mechanism by which the present invention additive provides the anti-wear protection is incompletely understood, it is presently believed that it involves a chemical reaction of the additive with the contacting metal surfaces. If other reactive species, such as amines, for example, are present in substantial amounts in the lubricating formulation, these can compete for interaction with the metal surfaces; hence, somewhat higher levels of the anti-wear agent are required in these situations for best results.

However, unnecessarily high levels of the anti-wear additive should also be avoided in order to avoid contributing to corrosion. Thus, the additive level should be sufficiently high to overcome the effects of any other competing species and to provide the anti-wear benefits, yet not so high as to unduly promote corrosion. The most effective level is easily determined in a given lubricating composition by routine experimentation.

In addition to the anti-wear additive, the lubricating composition can contain other conventional components such as antioxidants, viscosity index improvers, pour point depressants, anti-foam agents, anti-corrosion agents, and the like.

EXAMPLE I

A 150 g quantity (1.18 moles) of 1,5,9-decatriene was charged into a stainless steel reactor of about 500 cc capacity together with 224 g (6.6 moles) of hydrogen sulfide. Also charged was 1.5 g of trimethyl phosphite initiator and 0.3 g of naphthalene mercaptan initiator (the commercial product RPA Number 2). The reactor was fitted with a 100-watt Hanovia high pressure mercury vapor lamp.

The reaction was allowed to proceed for 6.75 hours at 175 psig and at 10°–11° C. The reaction mixture was then removed from the reactor and stripped of hydrogen sulfide and decatriene on a rotary evaporator operating under vacuum (Rota Vac) yielding 188.3 g of product.

The product was found to have a total sulfur content of 32 weight percent and a mercaptan sulfur content of 22 weight percent. Its molecular weight was found to be about 306, indicating that its mercaptan functionality was about 2.1 mercaptan groups per molecule.

EXAMPLE II

The invention anti-wear additive prepared in Example I, was incorporated into a lubricating motor oil composition and the wear properties of this lubricating composition were then measured by the Falex method using a modified ASTM D 2670-67 method. For purposes of comparison, a similar lubricating composition containing the well-known ZDTP additive was also prepared and its wear properties were also measured.

The lubricating oil composition which was used as a vehicle for these tests was one of commercial motor oil quality. The composition of this motor oil formulation with the exception of the anti-wear additive was as follows:

| Volume Percent | Description | Purpose |
|---|---|---|
| 86.4 | Lubricating Oil[a] | |
| 7.1 | Phil-Ad 100[b] | Dispersant |
| 4.1 | Lubrizol 934[c] | Ashless Dispersant |
| 2.2 | Phil-Ad VII[d] | Viscosity Index Improver |
| 0.2 | Acryloid 152[e] | Pour Point Depressant |

[a]-A refined, generally paraffinic Mid-Continent lubricating oil blend of SAE 10-stock and 20-stock lubricating oil.
[b]-A commercial calcium petroleum sulfonate overbased with lime to give a 100 base number; a trademark of Phillips Petroleum Company.
[c]-A mixture of 90 percent by weight polyisobutenyl succinic ester and 10 percent by weight of a mixture of polyisobutenyl succinamide and a succinamide derived from polybutenyl succinic anhydride and alkylene polyamines.
[d]-A hydrogenated butadiene-styrene copolymer; a registered trademark of Phillips Petroleum Company.
[e]-A poly-methacrylate-based resin.

As mentioned, the above composition contains no anti-wear additive and, if subjected to the wear measurement test, results in severe metallic wear.

The wear tests were carried out using the well-known Falex test machine in accordance with a slight modification of the ASTM D 2670-67 procedure. In the procedure used, a rotating steel pin, 0.635 cm (0.25 in.) in diameter was rotated at 290 rpm between two "V" steel blocks for one-half hour of break-in at an applied load of 23 kg (50 lb.) followed by three hours of additional testing at 113 kg (250 lbs.) applied load. During this time, the rotating pin and V block were submerged in 60 ml of the test oil. During the break-in period, the oil, pin, and V block were heated to 79.5° C (175° F). However, the temperature was not controlled during the test period, but it was allowed to increase or decrease depending upon the amount of frictional heat produced during the test.

The wear was measured by the number of radial degrees of teeth which a ratchet wheel pressure loader must be advanced to maintain a constant pressure during the course of the test. A good lubricant composition would typically result in a wear equivalent to a relatively few teeth (10–20) while a poor lubricating composition would typically require the wheel to be turned through many teeth (50–100). The table below shows additive level in total weight percent added and also in weight percent total sulfur added.

The results of the tests are shown in the table below.

| Addition Level, Weight Percent | | | |
|---|---|---|---|
| Total Wt. Basis | Sulfur Basis | Anti-Wear Agent | Wear (No. of Teeth) |
| 0 | 0 | None | >100[a] |
| 0.6 | 0.2 | Invention Product of Example I | 1 (avg. of 2) |
| 0.3 | 0.2 | 1,2,3-Propanetrithiol | 34 |
| 1 | 0.2 | n-Dodecyl Mercaptan | 38 (avg. of 2) |
| 1.1 | 0.2 | ZDTP | 11.5 (avg. of 5) |

[a]-Wear rate too great for test to be completed.

The wear results of the table above show that lubricating motor oil composition, in the absence of any anti-wear agent, results in a very high degree of wear. The data also show that the incorporation of either the ZDTP or the invention additive greatly reduces the wear to a very acceptable level. The wear level with the invention additive is particularly low.

The data also show that the invention anti-wear additive is also superior to the closely related 1,2,3-propanetrithiol as well as to the closely related n-dodecyl mercaptan. These data illustrate that not all sulfur-containing organic compounds are equivalent in motor oils. Indeed, not all mercaptan-containing compounds are equivalent as anti-wear agents in lubricating oils.

EXAMPLE III

The invention additive of Example I was also tested in an ashless lubricating oil formulation. The composition of this lubricating oil formulation, excluding the anti-wear agent, was as follows:

| Volume Percent | Description | Purpose |
|---|---|---|
| 88.2 | Lubricating Oil[a] | |
| 7.5 | Lubrizol 925[b] | Ashless Dispersant |
| 2.5 | Phil-Ad- VII[c] | Viscosity Index Improver |
| 0.2 | Acryloid 152[d] | Pour Point Depressant |
| 0.1 | Vanlube PN[e] | Antioxidant |
| 0.5 | Ethyl 702[f] | Antioxidant |
| 1.0 | Vanlube SS[g] | Antioxidant |
| 10 ppm | D.C. 200[h] | Foam Depressant |

[a]-Same as in Example II.
[b]-A mixture of polyisobutenyl succinamide and a succinamide derived from polybutenyl succinic anhydride and alkylene polyamines.
[c]-Same as in Example II.
[d]-Same as in Example II.
[e]-phenyl-beta-naphthylamine.
[f]-4,4'-Methylenebis(2,6-di-tert-butylphenol).
[g]-Mixture of octylated diphenylamines.
[h]-A silicone oil.

The wear measurement tests were carried out as in Example II. The results of these tests are shown below.

| Addition Level, Wt. %, Total Weight Basis | Anti-Wear Agent | Wear (No. of Teeth) |
|---|---|---|
| 0.0 | None | >100[a] |
| 0.6 | Invention Prod. of Example I | >100[a] |
| 2.0 | Invention Prod. of Example I | 123 |

[a]-Wear rate was too great for test to be completed.

The data in the table above illustrate that optimum levels of the invention additive are dependent upon the specific lubricating formulations employed. Whereas a 0.6 weight percent level was extremely effective in the lubricant of Example II, 0.6 weight percent was inadequate in this formulation, and the results indicate that a 2.0 weight percent level was barely effective and that a level greater than 2.0 weight percent would be more effective. The 123 teeth result at the 2.0 weight percent level is considered a marginal passing of the test in that the lubricant mixture permitted a full completion of the test. At the 0.0 and 0.6 weight percent levels, the test could not be completed at all.

EXAMPLE IV

In the same manner as in preceding Examples II and III, Falex wear tests were carried out on a heavy white mineral oil of 264 SUS at 100° F viscosity. The results are shown below:

| Addition Level, Wt. %, Total Weight Basis | Anti-Wear Agent | Wear (No. of Teeth) |
|---|---|---|
| 0.0 | None | >100[a] |
| 0.6 | Invention Product of Example I | 78[b] |
| 0.2 | Invention Product of Example I | 66 (avg. of 2) |

[a]-Wear rate too greater for test to be completed.
[b]-Completed test but load dropped from 250 lb. to 220 lb. about 30 minutes before completion of test.

These data again illustrate that the invention additive is applicable to different mineral oils compositions and that the optimum addition level depends upon the total formulation of the lubricant composition.

We claim:

1. A lubricating composition comprising a major proportion of a mineral lubricating oil containing a small but effective amount, sufficient to improve the anti-wear properties of the resulting lubricating composition, of an additive which is the product formed by reacting 1,5,9-decatriene and hydrogen sulfide in the presence of UV radiation in the range of about 100 to about 400 Angstroms.

2. A composition according to claim 1 wherein the lubricating oil contains from about 0.1 to about 4 weight percent of said additive based on total composition.

3. A composition according to claim 1 wherein the lubricating oil contains from about 0.3 to about 2 weight percent of said additive based on total composition.

4. A composition according to claim 1 wherein said mineral lubricating oil has a Saybolt viscosity at 210° F of from about 30 to about 250 and the amount of product additive present ranges from about 0.1 to about 4 weight percent based on total composition.

5. A composition according to claim 1 wherein said reaction product is prepared by reacting 1,5,9-decatriene with hydrogen sulfide in the presence of about 2 to about 10 moles of hydrogen sulfide per mole of 1,5,9-decatriene and wherein the conditions of reaction including time, temperature, and pressure are sufficient to provide a reaction product mixture in which at least about 75 mole percent of the 1,5,9-decatriene has been converted to sulfur-containing compounds.

6. A composition according to claim 1 wherein unreacted 1,5,9-decatriene and hydrogen sulfide are removed from the reaction product mixture prior to incorporation into said mineral lubricating oil.

7. A composition according to claim 1 wherein said reacting is carried out at a temperature in the range of about 0° to about 150° C for a period of time ranging from about one to about 24 hours.

* * * * *